US006495777B1

(12) United States Patent
Chou

(10) Patent No.: US 6,495,777 B1
(45) Date of Patent: Dec. 17, 2002

(54) PRESSURE SWITCH

(75) Inventor: Chiu-Sung Chou, Chia-Yi (TW)

(73) Assignee: Chin Ray Industry Ltd., Chia-Yi (TW)

( * ) Notice: Subject to any disclaimer, the term of this patent is extended or adjusted under 35 U.S.C. 154(b) by 38 days.

(21) Appl. No.: 09/665,319

(22) Filed: Sep. 19, 2000

(51) Int. Cl.[7] ..... H01H 35/24

(52) U.S. Cl. ..... 200/83 R; 200/83 J; 200/83 P; 200/83 S; 200/83 SA

(58) Field of Search ..... 200/81 R–81.9 HG, 200/82 R–82 E, 83 R, 83 J, 83 S, 83 P, 83 SA

(56) References Cited

U.S. PATENT DOCUMENTS 2,828,391 A * 3/1958 Slonneger ..... 200/83 S X
3,348,009 A * 10/1967 Staples ..... 200/83 S X
3,773,991 A * 11/1973 Krieger et al. ..... 200/83 P X
3,984,650 A * 10/1976 Budlane et al. ..... 200/83 P
4,168,415 A * 9/1979 Edwards, Jr. et al. ..... 200/83 J
4,446,614 A * 5/1984 Haag ..... 200/83 J X
4,471,182 A * 9/1984 Wielgos et al. ..... 200/83 P X
4,510,763 A * 4/1985 Johnson ..... 200/83 P
4,532,389 A * 7/1985 Woods ..... 200/83 P X

* cited by examiner

*Primary Examiner*—J. R. Scott
(74) *Attorney, Agent, or Firm*—Bacon & Thomas, PLLC

(57) ABSTRACT

A pressure switch. The switch includes a pressure sensor device adapted for receiving the input pressure and then moving the link rod due to the deformation caused by the input pressure. The switch includes a contact point fine-tuner having a first contact point controlled by the link rod, and is capable of separating or contacting a second contact point, and the contact point fine-tuner is mounted on a frame extended upwards from the pressure sensor device. The link rod of the pressure sensor device has a rotary plate, and the rotary plate includes a top leaning portion. By adjusting the position of the rotary plate on the link rod the controlling relationship between the first contact point of the contact point fine-tuner is attached to adjust different predetermined pressure values.

12 Claims, 2 Drawing Sheets

PRESSURE SWITCH

BACKGROUND OF THE INVENTION

1. Field of the Invention

The present invention relates to a pressure switch, which is applicable for the control of a pressure switch of a small air compressor device, and is capable of fine-tuning the values for configuration and the pressure difference thereof.

2. Description of the Related Art

There are many conventional pressure switches and those incorporating the application of an air compressor are frequently used, which mainly use the principle for the Baton tube or membrane. When the pressure of the compressor is accumulated to a certain predetermined value, the switch will have intermittent actions and stop the air compressor from increasing its pressure. Until the pressure in the air compressor is reduced to a certain predetermined value, the switch will resume its action of continual increase of the pressure. The pressure switch of this sort has a factory default value for a maximum pressure and a minimum pressure, such as 25–35 pounds per square inch (p.s.i.) or 95–105 p.s.i. Therefore, when there is a need for several maximum and minimum pressure differences, we have to buy pressure switches having different predetermined values for the upper limit and lower limit of the pressure, and it is relatively inconvenient and more expensive. The pressure switch of some large air compressors may have the function of fine-tuning the predetermined pressure value and the pressure difference, but its application is too complicated and has a numerous and large lever mechanical structure for the control of the transmission between the pressure source and the switch, and is not applicable for the small air compressors which only allows for very small space for the control between pressure source and the switch.

SUMMARY OF THE INVENTION

The objective of this invention is to provide an improved pressure switch which comprises a pressure sensor means for receiving the input pressure and then moving the link rod due to the deformation caused by the input pressure. A contact point fine-tuner having a first contact point is controlled by the link rod and is capable of separating or contacting a second contact point, and the contact point fine-tuner is mounted on a frame that is extended upwards from the pressure sensor means. The link rod of the pressure sensor means has a rotary plate, and such rotary plate comprises a top leaning portion. By adjusting the position of the rotary plate on the link rod, this changes the controlling relation between the first contact point of the contact point fine-tuner to adjust different predetermined pressure values. The contact point fine-tuner has a fine-tuning screw set, which changes the distance between the first contact point and the second contact point by the displacement of the screw set in order to adjust different pressure differences controlled by the pressure switch.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
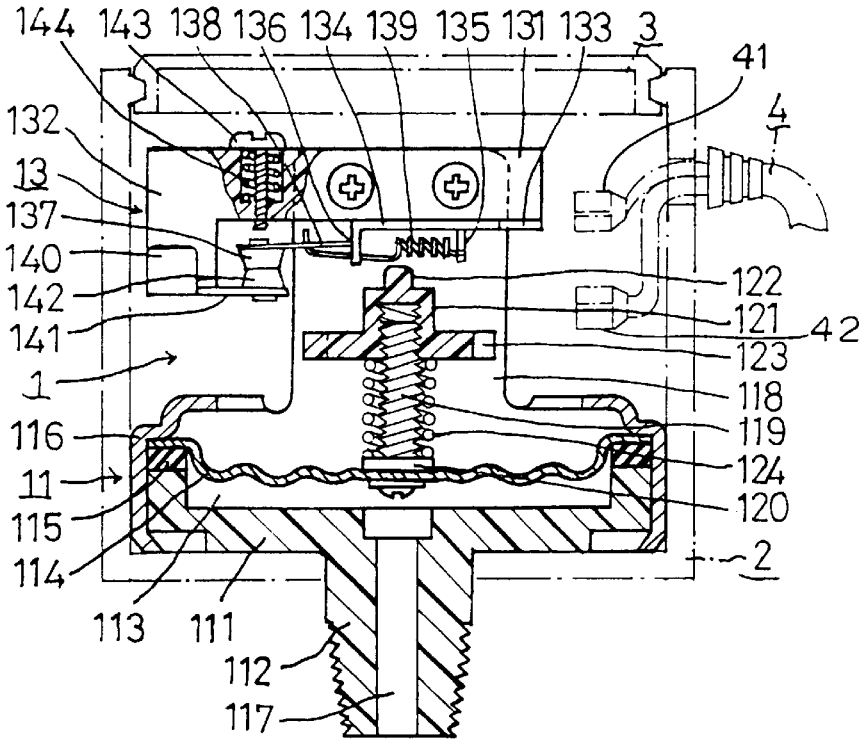
FIG. 1 shows the structure of a preferred embodiment of the present invention partially in section.

In the detailed description of the preferred embodiments, it should be noted that like elements are generally indicated by the same reference numerals throughout the disclosure.

Referring to FIG. 1, a pressure switch 1 of the preferred embodiment according to the present invention can be accommodated in a cylindrical housing 2, which makes adjustment to the pressure switch in the interior thereof by opening a lid member 3 that covers the top of the housing. Meanwhile, the pressure switch has a first contact point 133 and a second contact point 140 in contact with end sleeves 41, 42 of an electric wire 4 that extend to the exterior of the housing 2 and is coupled with an air compressor. The structure of the pressure switch mainly comprises a pressure sensor device 11 and a contact point fine-tuner device 13, wherein the pressure sensor device 11 comprises a bottom base of a conducting pipe 112 for coupling to a pressure source, and the bottom base has a pressure chamber 113 at a groove region which is covered by a sealed ring 115 of a flexible member on a membrane 114 at the curved surface of a flexible metallic substance which latches the membrane 114 and the bottom base 111 by a hooped ring 116 to seal the pressure chamber 113, so that gas can only be input through the air pipe 117 of the conducting pipe 112 to the pressure chamber 113. The hooped ring 116 has a self hooped ring peripherally extending towards the center thereof and inclined to the frame base 118, and a link rod 119 is mounted on the membrane 114. The link rod 119 having a shoulder base 120 is disposed near the membrane 114 and screw threads are formed on the link rod 119. The link rod 119 corresponding to the opposite axial end of the membrane 114 has a rotary plate 121 mounted onto it by screws. The upper section of the rotary plate 121 has a supporting portion 122 with a smaller cross-sectional diameter, and the lower section of the rotary plate 121 has a gear 123 with a structure similar to that of ordinary gears. An elastic member 124 composed of a tension spring is mounted outside the link rod 119 between the lower section of the gear 123 of the rotary plate 121 and the upper section of the shoulder base 120 of the link rod 119. The said contact point fine-tuning device 13 comprises a fixing base 131 on the middle frame 118 of the pressure sensor device 11 mounted into position by screws, and the fixing base 131 is made of insulating material, and one of its ends is bent into a bent section 132. The lower section of the fixing base 131 forms an electrically conductive bracket 134 with a first contact point 133, and a stopper section 135 is disposed at the position extending downwards, and a blocking section 136 is formed at an end thereof having an open groove at its lower portion. The blocking section 136 close to the middle section is slightly concave, and a spring 138 of the upper contact point 137 at an end extends downwards at that location. The spring 138 has a latch hole (not shown in the figure) latched by an elastic member 139 of the stopping section 135. An electrically conductive bracket 141 of the second contact point 140 is positioned at the lower portion of the bent section 132 of the fixing base 131, and one of the ends of the bracket 141 has a lower contact point 142 that always keeps in close contact with the upper contact point 137 under normal conditions, and a fine-tune screw member 143 is positioned above the upper contact point 137 and attached to the fixing base 131, and the screw member 143 is supported by the an elastic member 144.

Figure 2:
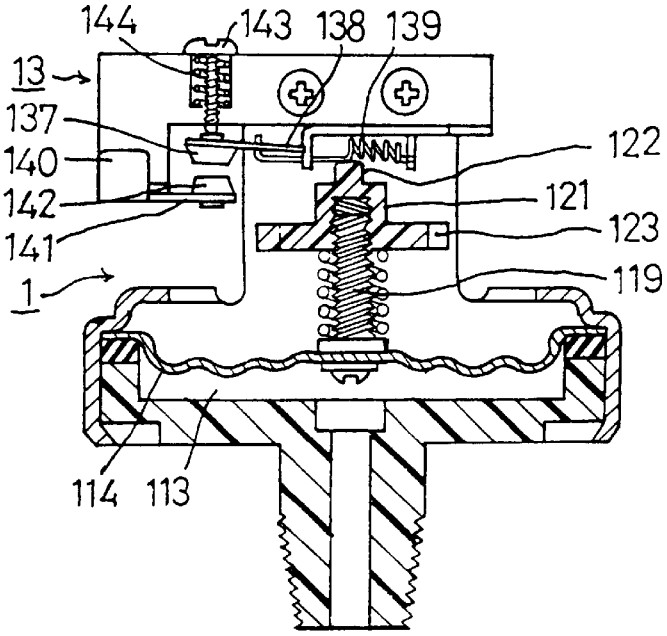
FIG. 2 shows the movement of the contact point fine-tuner device according to a preferred embodiment of the present invention.

The preferred embodiment of the present invention incorporates the coupling of the pressure source with the conducting pipe 112 of the pressure sensor device 11 of the pressure switch 1, and permits discharge of air pressure into the pressure chamber 113 through the air pipe 117 which makes the pressure chamber 113 to expand and move the membrane 114 which in turn moves the link rod 119 upwards. By pressing the elastic member 139 of the contact point fine-tuning means with the upper support section of the rotary plate 121, the link rod 119 moves the upper contact point 137 at one end of the spring bracket 138 away from the lower contact point 142 on the electrically conductive bracket 141 to separate the contact points as shown in FIG. 2. The pressure in the pressure chamber 113 has a first set value, and the first set value is one that has to be overcome when the air compressor increases the pressure to a certain extent.

When the pressure of the air compressor is released after use, the pressure chamber 113 in the pressure switch is reduced, and the link rod 119 on the membrane 114 and the upper support section of the rotary plate 121 moves downwards. Since there is no other external force on the elastic member 139, the resuming force on the member 139 will bring the upper contact point 137 contacting the spring bracket 138 downwards to the lower contact point 142 on the electrically conductive bracket 141 as shown in FIG. 1. The pressure in the pressure chamber 113 has a second set value, and the second set value is also the value that needs to be overcome when the air compressor increases its pressure to a certain extent.

Due to the elasticity of the elastic member 139 of the contact point fine-tuning device 13, when the upper support section 122 of the rotary plate 121 is pressed, the member 139 will not immediately move the upper contact point 137 of the spring bracket, there will be a delay time period, so that a pressure difference is generated between said first set value and second set value. When the upper contact point 137 and the lower contact point 142 are separated from each other, the elastic member 139 has already been pressed by the support section 122 to become a curved shape. Only when the support section 122 moves down to the elastic member 139 and resumes the substantially position with the spring bracket 138 (this time period is the delay time, which occurs when the pressure difference is generated), then the spring bracket 138 can bring the upper contact point 137 and the lower contact point 142 together by moving itself downward.

To adjust the upper limit for the pressure, the gear 123 of the rotary plate 121 is moved to lift or lower the support section 122. If the support section 122 is lifted, the section 122 reaches the elastic member 139 more quickly, therefore this permits for a lower upper limit for the pressure, however, the upper limit for the pressure will be higher.

The difference between the upper limit and the lower limit for the pressure (that is the adjustment of the lower limit of the pressure) depends on the extent of the downward screwing of the fine-tuning screw 143 to change the time interval when the upper contact point 137 and the lower contact point 142 are separated from each other. If the time interval is reduced, once the upper support section 122 of the rotary plate 121 drops, the faster the upper contact point 137 will reach the lower contact point 142, and the controlled pressure difference will be smaller, otherwise the pressure difference will be greater.

Figure 3:
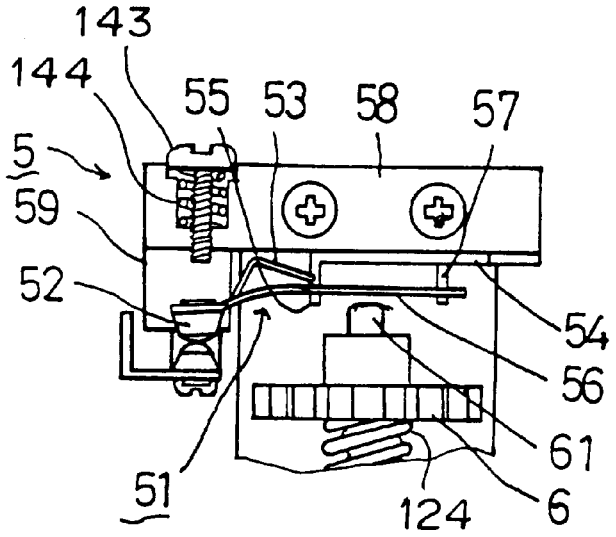
FIG. 3 shows the structure of the contact point fine-tuner device of another preferred embodiment of the present invention.
Figure 4:
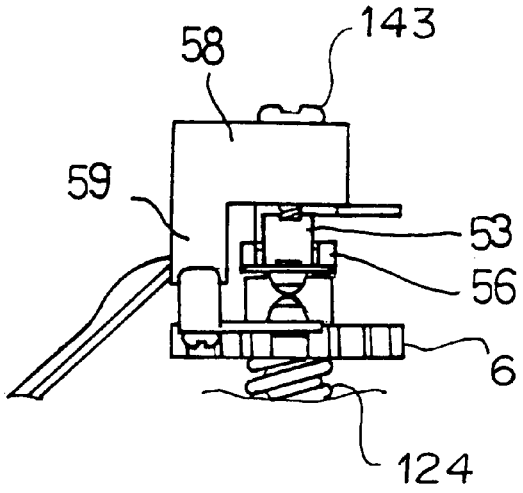
FIG. 4 is a side view of FIG. 3.

The second preferred embodiment of the present invention as shown in FIG. 3 provides a contact point fine-tuning device 5 which substitutes the spring bracket 138 and an elastic member 139 shown in FIG. 1 with a single-piece composed of a spring member 51 having the elastic property. The end of the spring member 51 includes an upper contact point 52, and the other end is split into a bent spring bracket 53 supporting the blocking section 55 of the electrically conductive bracket 54 having a slightly concave groove at the middle section, and the other end is split into a longer spring bracket 56 latched to the stopper section 57 of the foregoing electrically conductive bracket 54. Therefore, the upper support section 61 of the rotary plate 6 acts on the spring bracket 56 in a very similar manner as the action of the upper support section on the elastic member 139 as shown in FIG. 1 for the first preferred embodiment. In addition, the upper support section 61 of said rotary plate 6 is made of metallic material to reduce wear. The bent section 59 of the fixing base 58 can be moved to the back of the fixing base as shown in FIG. 4.

The mechanical design of the preferred embodiment according to the present invention does not only fine-tune the set pressure value and the pressure difference, but it also places the rotary plate on the end of the opposite axial direction of the membrane with respect to the link rod, and the elastic member on the contact point fine-tuning device pressed by the upper support section on the rotary plate is directly disposed on the top end of the rotary plate. The overall contact point fine-tuning means is fixed on the frame extended upward from the pressure sensor means which allows the interaction of each components to be operated in a very small space, and is applicable for use as the pressure control switch for small air compressors.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. A pressure switch comprising:

a deformable pressure sensor device;

a link rod attached to the pressure sensor device;

the pressure sensor device adapted to receive a pressure input and deform according to the pressure input such that the pressure input causes deformation of the pressure sensor device which then moves the link;

a contact point fine-tuning device comprising first and second contact points, movement of the first contact point is controlled by the link rod and the first contact point is detachably contacted with the second contact point when the input pressure is not present, the first contact point is connected to an elastic member positioned above the pressure sensor device;

a frame base positioned above the pressure sensor device, the frame base extends upwards from the pressure sensor device and is fixed to the contact point fine-tuning device, the contact point fine-tuning device is disposed on the frame base;

a rotary plate adjustably attached to the link rod, the rotary plate includes a supporting section adapted for contacting the elastic member;

a contact point fine-tuner device positioned above the first contact point, the distance between the contact point fine-tuner and the first contact point is adjustable;

when the pressure input causes the deformation of the pressure sensor device, the supporting section of the rotary plate pushes the elastic member, thereby causing separation between the first and second contact points after a time delay due to the elasticity of the elastic member; and by adjusting the distance between the contact point fine-tuner device and the first contact point, as well as the distance between the supporting section of the rotary plate and the elastic member, the pressure input required to activate the separation between the first and second contact points can be customized.

2. The pressure switch as claimed in claim 1, wherein said rotary plate is disposed at an end thereof on the opposite axial direction of a membrane with respect to the link rod.

3. The pressure switch as claimed in claim 1, wherein said rotary plate comprises a plurality of gears.

4. The pressure switch as claimed in claim 1, wherein said rotary plate is pushed towards the elastic member by the pressure input.

5. The pressure switch as claimed in claim 4, wherein said elastic member is disposed at a position between a shoulder section of the link rod near the pressure sensor device and the rotary plate.

6. The pressure switch as claimed in claim 1, wherein said pressure sensor device comprises a bottom base having a pressure chamber being covered by a membrane, and said pressure chamber being hermetically sealed by a hooped ring, and the membrane is disposed on the link rod.

7. The pressure switch as claimed in claim 6, wherein said first contact point and said second contact point are disposed on a fixing base secured above the frame base.

8. The pressure switch as claimed in claim 7, wherein said fixing base is disposed on the frame base extended from a periphery of the hooped ring and inclined towards the center of the pressure sensor device.

9. The pressure switch as claimed in claim 1, wherein said spring and said elastic member are one-piece comprising an elastic spring member, an end of the spring member is coupled to said contact point, and the other end of the spring member splits into a blocking section for an electrically conductive bracket pressed by a spring, and an elastic spring is latched to a stopping section of the electrically conductive bracket.

10. The pressure switch as claimed in claim 1, wherein the upper portion of the support section of said rotary plate is made of a metallic material.

11. The pressure switch as claimed in claim 1, wherein the contact point fine-tuner device further comprises a fine-tuning screw which is capable of changing the time interval for separating the first contact point and the second contact point by adjusting screw displacement in order to adjust the overall pressure switch for different pressures.

12. The pressure switch as claimed in claim 11, wherein an end of said fine-tuning screw member is able to be in contact with the first contact point, and said fine-tuning screw member is adapted for fine-tuning the adjustment of the displacement of the first contact point from the fine-tuning screw member.

* * * * *